US008755698B2

(12) United States Patent
Morales-Tirado et al.

(10) Patent No.: US 8,755,698 B2
(45) Date of Patent: Jun. 17, 2014

(54) SYSTEM AND METHODS FOR USING TONER SHAPE FACTOR TO CONTROL TONER CONCENTRATION

(75) Inventors: Juan A. Morales-Tirado, Henrietta, NY (US); Yolanda E. Maldonado, Webster, NY (US); Blaise L. Luzolo, Rochester, NY (US); Michael L. Grande, Palmyra, NY (US)

(73) Assignee: Xerox Corporation, Norwalk, CT (US)

( * ) Notice: Subject to any disclaimer, the term of this patent is extended or adjusted under 35 U.S.C. 154(b) by 109 days.

(21) Appl. No.: 13/617,092

(22) Filed: Sep. 14, 2012

(65) Prior Publication Data

US 2014/0079413 A1 Mar. 20, 2014

(51) Int. Cl.
*G03G 15/08* (2006.01)

(52) U.S. Cl.
USPC ..... 399/27; 399/30; 430/110.3

(58) Field of Classification Search
USPC ..... 399/27, 30, 62, 63; 430/110.3, 122.1, 430/122.2, 122.5, 123.41
See application file for complete search history.

(56) References Cited

U.S. PATENT DOCUMENTS

| | | | | |
|---|---|---|---|---|
| 2006/0172217 | A1 * | 8/2006 | Kidokoro | 430/110.3 |
| 2006/0204290 | A1 * | 9/2006 | Omata | 399/309 |
| 2008/0089708 | A1 | 4/2008 | Gross et al. | |
| 2009/0004590 | A1 * | 1/2009 | Yamamoto et al. | 430/110.3 |

FOREIGN PATENT DOCUMENTS

JP 2006-084920 A * 3/2006

* cited by examiner

*Primary Examiner* — Sophia S Chen
(74) *Attorney, Agent, or Firm* — Pillsbury Winthrop Shaw Pittman LLP

(57) ABSTRACT

System and methods for controlling toner properties in a two component development system through the toner shape factor. In particular, the present embodiments provide a method for controlling toner concentrations by tailoring the circularity value ranges of the toner particles to prevent dysfunctions and provide a more robust and optimized xerographic system.

20 Claims, 4 Drawing Sheets

SYSTEM AND METHODS FOR USING TONER SHAPE FACTOR TO CONTROL TONER CONCENTRATION

BACKGROUND

The present embodiments relates generally to a system and methods for controlling or tuning toner concentration through specific toner properties. Specifically, the present embodiments configure the toner shape factor, such as circularity, to easily control or tune toner concentration. The present methods provide a cost efficient way in which to optimize system operation and obtain more robust system.

Electrophotography, which is a method for visualizing image information by forming an electrostatic latent image, is currently employed in various fields. The term "electrostatographic" is generally used interchangeably with the term "electrophotographic." In general, electrophotography comprises the formation of an electrostatic latent image on a photoreceptor, followed by development of the image with a developer containing a toner, and subsequent transfer of the image onto a transfer material such as paper or a sheet, and fixing the image on the transfer material by utilizing heat, a solvent, pressure and/or the like to obtain a permanent image.

In electrostatographic reproducing apparatuses, including digital, image on image, and contact electrostatic printing apparatuses, a light image of an original to be copied is typically recorded in the form of an electrostatic latent image upon a photosensitive member and the latent image is subsequently rendered visible by the application of electroscopic thermoplastic resin particles and pigment particles, or toner. In a conventional electrophotographic process, a latent image is electrically formed on a photoreceptor containing a photoconductive material using any of various methods. The latent image is developed with a toner, and the toner image on the photoreceptor is transferred, directly or via an intermediate transfer member, to an image-receiving film such as paper. The transferred image is fixed by application of, for example, heat, pressure, heat and pressure, or a solvent vapor. A fixed image is formed through the plural steps described above.

Electrophotographic imaging members may include photosensitive members (photoreceptors) which are commonly utilized in electrophotographic (xerographic) processes, in either a flexible belt or a rigid drum configuration. Other members may include flexible intermediate transfer belts that are seamless or seamed, and usually formed by cutting a rectangular sheet from a web, overlapping opposite ends, and welding the overlapped ends together to form a welded seam. These electrophotographic imaging members comprise a photoconductive layer comprising a single layer or composite layers.

There is a constant desire to improve the characteristics and performance of toner compositions. One area of possible improvement focuses on how the toner is used and interacts with the xerographic system. Optical sensors are known and used in printing systems to detect transferred toner mass amounts through reflectance measurements. For example, U.S. Publication No. 2008/0089708, discloses use of optical reflective-based sensors to generate and compute reflection outputs to determine an amount of toner mass present on the toner application surface.

Toner concentration control in two component development systems is very important for multiple reasons. The interaction between toner and carrier particles in the development housing to a large extent drives charge generation, which is a critical parameter for system performance. Each development subsystem running a specific toner formulation has a unique latitude. If the system operates outside its latitude it can lead to significant variation in density as well as dysfunctions such as background, internal emissions (spits), and bead carryout. In extreme cases this dysfunction can be detected as severe image quality defects such as spots. Thus toner concentration control is maintained through a closed loop control system that monitors the degree to which the toner is developing, and also monitors the changes in the magnetic permittivity of the developer material in the development housing. The effectiveness of the control system, however, can be affected by dysfunctions in the components, including the photoreceptor, Reflection Automatic Density Control (RADC) sensor, Auto Toner Concentration (ATC) sensor, and also the developer material (including the toner) itself.

As such, the present embodiments are directed to a system and methods for controlling toner concentrations through the toner shape factor, and specifically, circularity, to prevent dysfunctions and provide a more robust and optimized xerographic system.

SUMMARY

According to aspects illustrated herein, there is provided a method for controlling toner concentration, comprising: providing a toner comprising toner particles; using the toner in an xerographic system to evaluate toner concentration; and adjusting a shape factor of the toner particles such that a toner concentration of the toner particles stays within from about 9 to about 12 percent of an operating space of the xerographic system.

Another embodiment provides a method for controlling toner concentration, comprising: providing a toner comprising toner particles; using the toner in an xerographic system to evaluate toner concentration, wherein the xerographic system comprises one or more sensors for measuring toner concentration; and adjusting a shape factor of the toner particles such that a toner concentration of the toner particles as measured by the one or more sensors stays within from about 9 to about 12 percent.

Yet another embodiment, there is provided a method for controlling toner concentration, comprising: providing a toner further comprising toner particles; using the toner in an xerographic system to evaluate toner concentration, wherein the toner concentration is measured by one or more sensors in the xerographic system; adjusting circularity of the toner particles according to the relationship Toner Concentration=−0.24*A+50*B+0.23*A*B−32, wherein A=Auto Toner Concentration Sensor Output and B=Circularity such that the toner particles have a toner concentration of from about 9 to about 12 percent.

BRIEF DESCRIPTION OF THE DRAWINGS

For a better understanding, reference may be made to the accompanying figures.

DETAILED DESCRIPTION

In the following description, reference is made to the accompanying drawings, which form a part hereof and which illustrate several embodiments. It is understood that other embodiments may be used and structural and operational changes may be made without departure from the scope of the present disclosure.

The present embodiments provide a system and method that allows the targeting of a specific toner concentration (TC) operating space by tailoring the shape of the toner particles. As used herein, the term "operating space" is defined as the TC space where the toner charge and charge distribution meet the requirements leading to acceptable image quality. The image quality is assessed by the density on the substrate, the level of background (toner developed on non-image areas), and the frequency of defects such as spots, smudges, and streaks. The operating TC space is determined by performing tests under different conditions (such as environment, components age, and print job area coverage) followed by an assessment of the image quality. The reaction of the process controls system is also assessed to make sure the sensors are not railing (at the edge of the control limits) and the system has acceptable control latitude. The present embodiments are very useful in domestication projects where new designs in hardware or toner materials result in a TC different from the original system specification. In such a case, a reduction in system latitude may occur which needs to be addressed by adjusting the sensors and set points of the image forming machine to address variations in toner properties, which is difficult and expensive to do for machines deployed in the field. As such, the present embodiments allow for control or tuning of the TC without the need for field technical adjustments to the sensors or image forming machines by instead tuning the toner properties for optimal performance. In the present embodiments, the tuning is easily performed during the toner manufacturing phase.

An image density is mainly controlled by a unit having an ATC sensor or that having an ADC sensor. The ATC sensor detects TC from a permeability of the carrier and controls the supply amount of the toner. The ATC sensor is typically installed around a developing machine. The ADC sensor, on the other hand, optically detects a toner image density on a photoreceptor and controls a toner adhering amount per unit area (which is called "DMA") on a photoreceptor based on a ratio of a reflected light amount between a non-image portion (clean surface) and a toner image portion on the photoreceptor. The ADC is typically installed around the photoreceptor.

Figure 1:
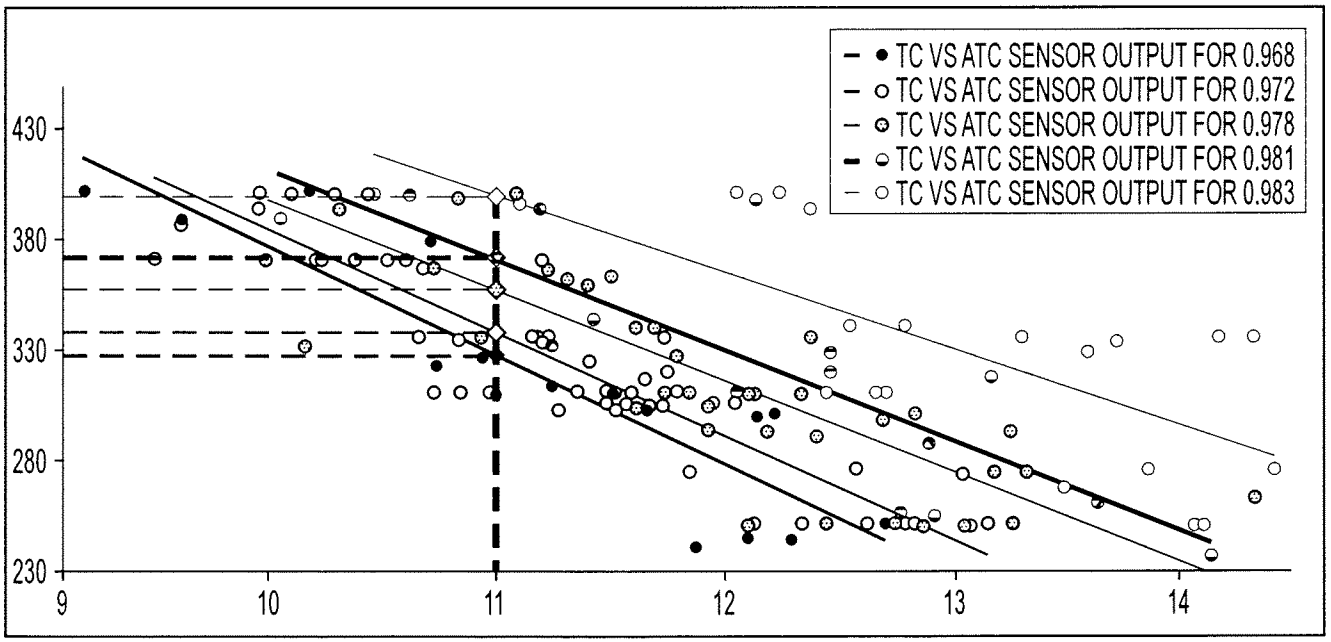
FIG. 1 is a graph illustrating the toner concentration of a developer for different ATC sensor outputs for two different toners having the same toner charge when operating at the same TC

The problem of TC latitude can be described by looking at FIG. 1. FIG. 1 shows the TC of the developer for different ATC sensor outputs for two different toners that have the same toner charge when operating at the same TC. The toners also have the same size and surface additive formulation. The ATC sensor is the sensor in the development housing that triggers adjustments in toner concentration based on magnetic permittivity. As can been seen, FIG. 1 shows that for the same ATC sensor output the toners operate at different TC.

FIG. 1 reveals a problem that is dependent on the system latitude. For instance, if the operating TC of the system should not exceed 12 percent then the materials represented by the green series will lead to a larger frequency of TC related defects. In this specific case the defects associated with high TC are spots caused by internal emissions from the development housing. The emissions accumulate on a seal roll that is located very close to the photoreceptor and picks up any carrier beads ejected from the development housing.

Figure 2:
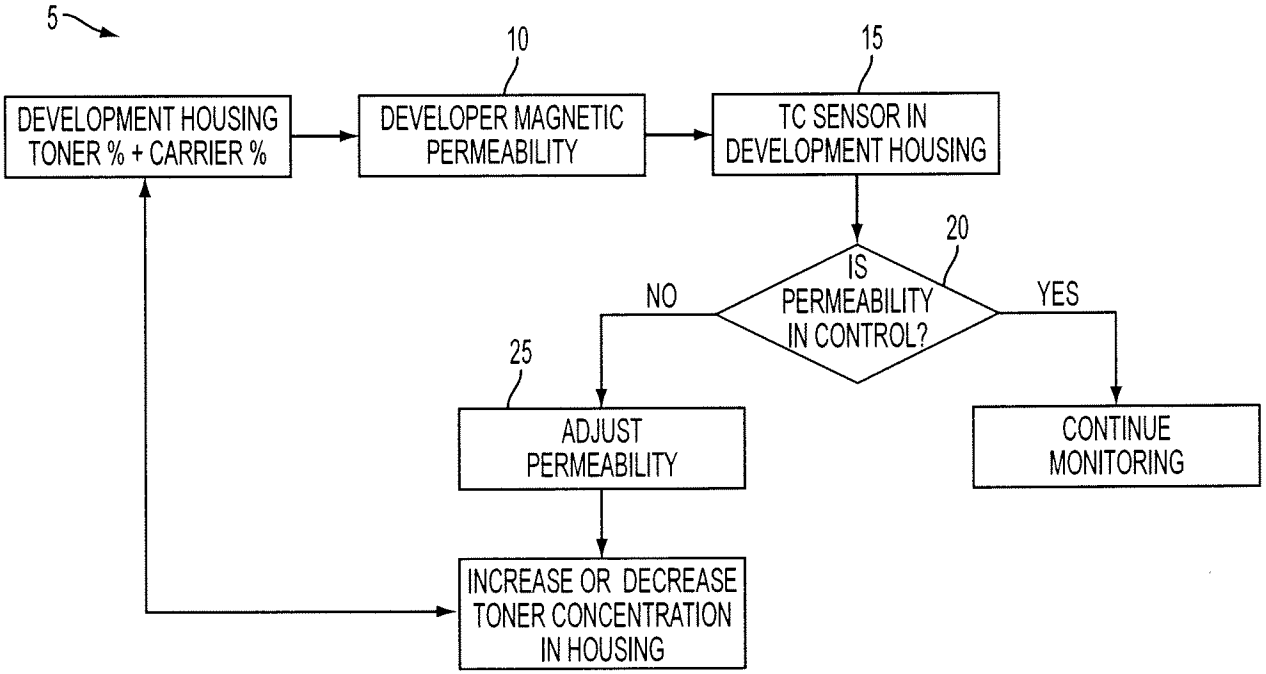
FIG. 2 is a flow diagram illustrating a closed loop control system for controlling toner concentration as used with the toners of the present embodiments.

The present embodiments help resolve the problems associated with system latitude and specifically, TC latitude. As mentioned above, toner concentration control is maintained through a closed loop control system that monitors the degree to which the toner is developing, and also monitors the changes in the magnetic permittivity of the developer material in the development housing. FIG. 2 provides a flow diagram illustrating this closed loop control system 5. The developer (toner and carrier) mixture has a level of magnetic permeability that is driven primarily by the bulk packaging of the developer 10. The TC sensor in the development housing monitors the magnetic permeability 15. If the magnetic permeability is out of range, the sensor will trigger a signal to adjust magnetic permeability 20. If the magnetic permeability is out of control, the permeability will be adjusted by adjusting the packing of the developer 25. At this point, the toners of the present embodiments will be useful for the adjustment. For example, the shape factor of the toner particles, such as circularity, can be used to make the system run within the TC space desired.

The inventors of the present embodiments have analyzed data from four commercially available toners that have been machine evaluated to understand the system latitude. The toners were used in a conventional xerographic system for evaluation. Namely, an electrostatic latent image was formed on the surface of a latent image holding member; the electrostatic latent image was developed with a developer comprising the various toners, thereby forming a toner image; the toner image formed on the latent image holding member was transferred to the surface of a recording medium; and the toner image was fixed on the surface of the recording medium, wherein the resulting image was evaluated.

The toners have very similar particle size and triboelectric properties and were made with the same surface additive package. In particular, the toners have a particle size of about 6 microns to about 7 microns and triboelectric charge of about 35 μC/g to about 45 μC/g. However, the shape factor (or circularity) was somewhat different between the toners. For example, the circularity of the toners tested ranged between 0.968 to 0.983 units. In this scale, the higher the circularity the closer the shape of the particle is to a perfect sphere. Conversely, the lower the circularity the more irregular the shape of the particle.

Figure 3:
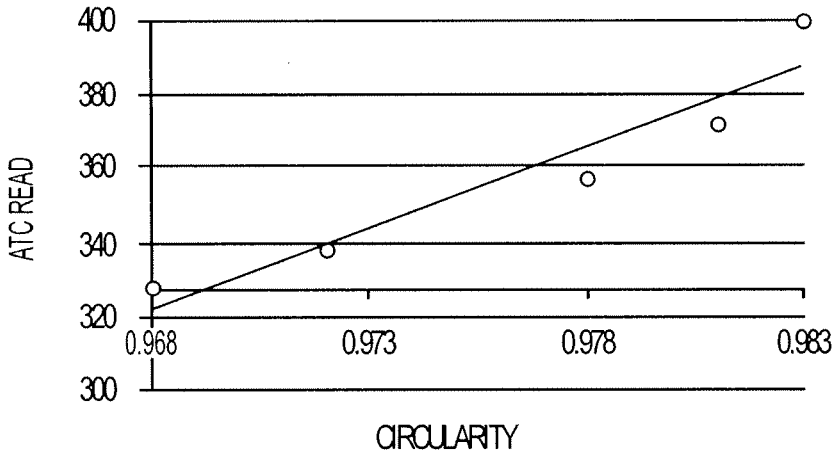
FIG. 3 is a graph illustrating a regression analysis performed after testing several toners to generate their characteristic ATC-TC response curve.

A regression analysis was performed after testing several toners with circularity ranging from 0.968 to 0.983. The tests were performed by fixing the TC of the developer in the machine to 11% and monitoring the response of the ATC sensor. The TC was fixed to 11% by operating the system in open loop control (manual) rather than in closed loop control to generate their characteristic ATC-TC response curve. The ATC sensor response was determined for a fixed TC (11 percent). A regression analysis was performed with the above data. The regression is shown graphically in FIG. 3. As can be seen, there is a correlation between the ATC sensor output response with circularity. The analysis in FIG. 3 shows that the circularity or shape factor of the toner particle can be used to re-center the operating TC of the system. This analysis was performed for a target TC of 11 percent, which is a reasonable target for the exemplary system. From a mechanical point of view, the data confirms that the present methods may be used to tune the developer flow by using the particle circularity as a "knob." The present methods tune the magnetic permittivity of the developer by driving the developer flow to the required target range. In particular, the present methods use circularity of the toner particles to adjust the magnetic permittivity of the developer (comprising toner and carrier) which in turn controls the TC sensor output response (which is driven by the magnetic permittivity of the developer).

Figure 4:
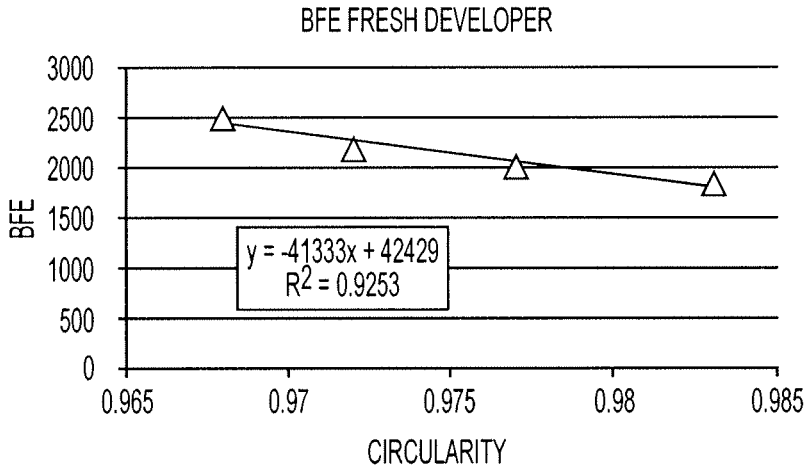
FIG. 4 is a graph illustrating the correlation between developer flow and toner particle circularity.

As shown in FIG. 4, the developer flow (Basic Flow Energy) can be tuned by particle circularity. The Basic Flow Energy is a measure of the energy required to initiate bulk flow under specific conditions. In toners prepared via the Emulsion Aggregation process the circularity is typically adjusted during the particle coalescence step. Process parameters such as the coalescence temperature, coalescence time, and slurry pH during coalescence are some of the parameters used to tailor the particle circularity. In our experiments we used the pH of the slurry as a knob to control the circularity. For instance, lowering the pH of the slurry during the temperature ramp up and coalescence step leads to an increase in the surface tension of the slurry and more spherical particles. Conversely, increasing the pH of the slurry reduces the surface tension and leads to more irregular shape particles, the present embodiments tune the toner particle circularity to maintain developer flow within a functional range, which in turn will reduce the variability in system TC which will avoid dysfunctions and will make the system more robust. For example, in embodiments, the developer flow measured by Basic Flow Energy is preferably from about 2000 to about 2700, or from about 2000 to about 2600, or from about 2200 to about 2500.

In present embodiments, the target range for circularity is from about 0.963 to about 0.976, or from about 0.965 to about 0.976, or from about 0.966 to about 0.976, or from about 0.966 to about 0.973, or from about 0.967 to about 0.976, or from about 0.969 to about 0.972.

In embodiments, the system and methods provide for making a more robust system which minimizes the instances where the TC falls outside the operating space of from about 9 percent to about 12 percent, or from about 9 percent to about 11 percent, or from about 10 percent to about 11 percent. In further embodiments, the target triboelectric charge range is from about 25 to about 60 μC/g, or from about 30 to about 50 μC/g, or from about 35 to about 45 μC/g. The triboelectric range is largely driven by the toner concentration.

Various exemplary embodiments encompassed herein include a method of imaging which includes generating an electrostatic latent image on an imaging member, developing a latent image, and transferring the developed electrostatic image to a suitable substrate.

While the description above refers to particular embodiments, it will be understood that many modifications may be made without departing from the spirit thereof. The accompanying claims are intended to cover such modifications as would fall within the true scope and spirit of embodiments herein.

The presently disclosed embodiments are, therefore, to be considered in all respects as illustrative and not restrictive, the scope of embodiments being indicated by the appended claims rather than the foregoing description. All changes that come within the meaning of and range of equivalency of the claims are intended to be embraced therein.

EXAMPLES

The examples set forth herein below and are illustrative of different compositions and conditions that can be used in practicing the present embodiments. All proportions are by weight unless otherwise indicated. It will be apparent, however, that the present embodiments can be practiced with many types of compositions and can have many different uses in accordance with the disclosure above and as pointed out hereinafter.

Example I

Functional Space

Figure 5:
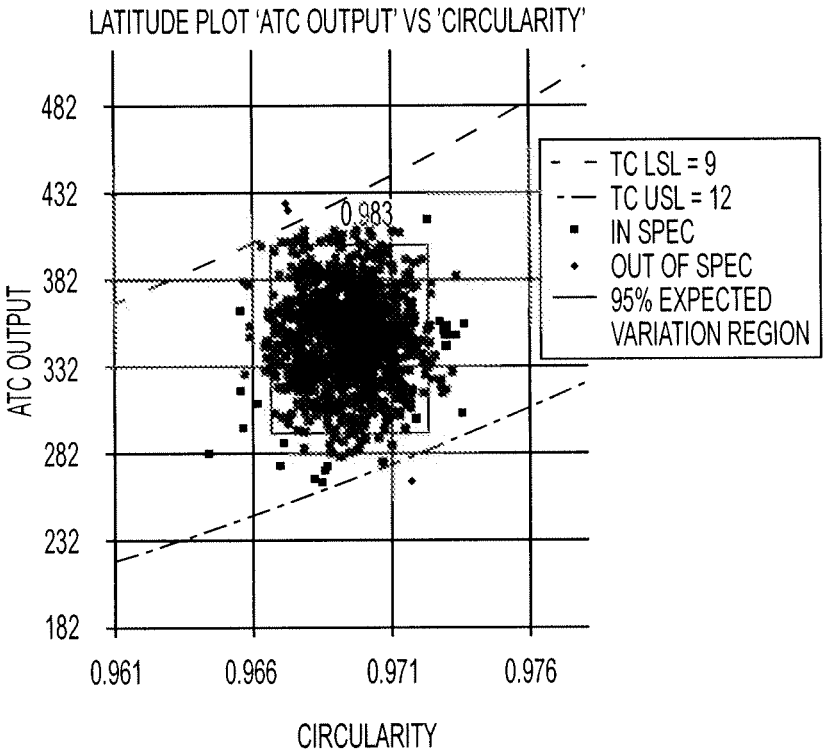
FIG. 5 is a graph illustrating a latitude plot of ATC sensor output versus toner particle circularity.

A predictive model was developed using the experimental data obtained above. The model takes into consideration variability in the TC control sensor and also the circularity of the toner particle. The model was then used to establish a toner particle shape range that makes the system more robust, meaning a shape range that provides least TC variability and achieves ATC sensor output in a desired range. For the test system, the model shows a range of from about 0.965 to about 0.973 for circularity that will make the system more robust and will minimize the instances where the TC falls outside the space of from about 9 percent to about 12 percent, as shown in FIG. 5.

Summary

In summary, the present embodiments provide a system and method for tailoring TC operating space without the need to change sensor set points or toner/developer material formulation. The embodiments allow for proper system and developer latitude such that system dysfunctions are avoided. The embodiments are easy to implement and easy to scale-up, requiring only small process adjustment required to modify the toner particle shape. Moreover, particle shape is an easily detectable property which can be readily measured and adjusted.

All the patents and applications referred to herein are hereby specifically, and totally incorporated herein by reference in their entirety in the instant specification.

It will be appreciated that several of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. A method for controlling toner concentration, comprising:

providing a toner comprising toner particles;

using the toner in an xerographic system to evaluate toner concentration; and adjusting a shape factor of the toner particles such that a toner concentration of the toner particles stays within from about 9 to about 12 percent of an operating space of the xerographic system.

2. The method of claim 1, wherein the toner concentration stays within about 9 to about 11 percent of the operating space of the xerographic system.

3. The method of claim 2, wherein the toner concentration stays within about 10 to about 11 percent of the operating space of the xerographic system.

4. The method of claim 1, wherein the shape factor is circularity of the toner particles.

5. The method of claim 4, wherein the circularity of the toner particles is from about 0.966 to about 0.976.

6. The method of claim 5, wherein the circularity of the toner particles is from about 0.967 to about 0.976.

7. The method of claim 6, wherein the circularity of the toner particles is from about 0.969 to about 0.972.

8. The method of claim 1, wherein the toner provided is produced by adjusting a slurry pH during coalescence of the toner particles to target a desired shape factor.

9. The method of claim 1, wherein the toner is combined with a carrier to form a developer before use in the xerographic system and the developer has a developer flow as measured by Basic Flow Energy of from about 2700 to about 2000.

10. A method for controlling toner concentration, comprising:

providing a toner comprising toner particles;

using the toner in an xerographic system to evaluate toner concentration, wherein the xerographic system comprises one or more sensors for measuring toner concentration; and adjusting a shape factor of the toner particles such that a toner concentration of the toner particles as measured by the one or more sensors stays within from about 9 to about 12 percent.

11. The method of claim 10, wherein the shape factor is circularity of the toner particles.

12. The method of claim 10, wherein the one or more sensors measure the toner concentration by detecting a magnetic permittivity of the toner particles.

13. The method of claim 10, wherein a triboelectric charge of the toner particles is from about 25 to about 60 μC/g.

14. The method of claim 13, wherein the triboelectric charge of the toner particles is from about 30 to about 50 μC/g.

15. A method for controlling toner concentration, comprising:

providing a toner further comprising toner particles;

using the toner in an xerographic system to evaluate toner concentration, wherein the toner concentration is measured by one or more sensors in the xerographic system;

adjusting circularity of the toner particles according to the relationship Toner Concentration=−0.24*A+50*B+0.23*A*B−32, wherein A=Auto Toner Concentration Sensor Output and B=Circularity such that the toner particles have a toner concentration of from about 9 to about 12 percent.

16. The method of claim 15, wherein toner particles have a toner concentration of from about 9 to about 11 percent.

17. The method of claim 16, wherein toner particles have a toner concentration of from about 10 to about 11 percent.

18. The method of claim 15, wherein the toner is combined with a carrier to form a developer before use in the xerographic system.

19. The method of claim 18, wherein the developer has a developer flow as measured by Basic Flow Energy of from about 2700 to about 2000.

20. The method of claim 19, wherein the developer has a developer flow as measured by Basic Flow Energy of from about 2000 to about 2600.

* * * * *